United States Patent [19]

Gilbert et al.

[11] 4,045,915

[45] Sept. 6, 1977

[54] PORTABLE SANDBLASTER

[75] Inventors: Neal J. Gilbert, Highland; Edward L. Horton, San Gabriel, both of Calif.

[73] Assignee: Enviro-Blast International, Los Angeles, Calif.

[21] Appl. No.: 620,052

[22] Filed: Oct. 6, 1975

[51] Int. Cl.[2] ..... B24C 3/06

[52] U.S. Cl. ..... 51/427; 51/429; 51/439; 15/346

[58] Field of Search ..... 15/345, 346; 51/8 R, 51/8 HD, 8 C, 9 M, 235, 319–321, 11

[56] References Cited

U.S. PATENT DOCUMENTS

| | | | |
|---|---|---|---|
| 2,724,928 | 11/1955 | Kirkland | 51/11 |
| 2,801,133 | 7/1957 | Ridley | 51/11 X |
| 3,137,974 | 6/1964 | Kirkland | 51/11 |
| 3,242,515 | 3/1966 | Baeten | 51/8 R X |
| 3,788,010 | 1/1974 | Goff | 51/9 M |
| 3,827,188 | 8/1974 | Fuma | 51/9 M X |
| 3,905,155 | 9/1975 | Smith | 51/8 R |
| 3,906,673 | 9/1975 | Goto | 51/9 M |
| 3,916,568 | 11/1975 | Rose | 51/8 R |

FOREIGN PATENT DOCUMENTS

| | | | |
|---|---|---|---|
| 160,839 | 2/1954 | Australia | 51/8 R |
| 1,809,678 | 5/1970 | Germany | 51/8 R |
| 2,506,740 | 8/1975 | Germany | 51/9 M |

*Primary Examiner*—Gary L. Smith
*Attorney, Agent, or Firm*—Paul A. Weilein

[57] ABSTRACT

A manually portable casing equipped with suitable handle means has an outer end opening and a sandblasting hood mounted in the casing has a corresponding outer end opening which fits into the outer end opening of the casing. A rotary blaster nozzle inside the hood is supplied with a stream of air entraining grit particles. A rim of the hood has a continuous resilient seal to contact a worksurface that is to be processed thereby to cut off the hood both from the atmosphere and the interior of the casing. The hood and its seal are shaped to cooperate with a particular worksurface configuration which may be concave, convex, angular, etc. Different hoods are used interchangeably to fit different worksurface configurations. A suction pump connected to the hood maintains a relatively high vacuum therein and thus tends to compress the seal against the worksurface with force which, if unopposed, would immobilize the sandblaster, but a plurality of thrust members around the hood make rolling contact with the worksurface and thus divert a sufficient portion of the force to relieve the seal sufficiently to make the hood readily manually movable along the worksurface.

16 Claims, 13 Drawing Figures

FIG. 1.
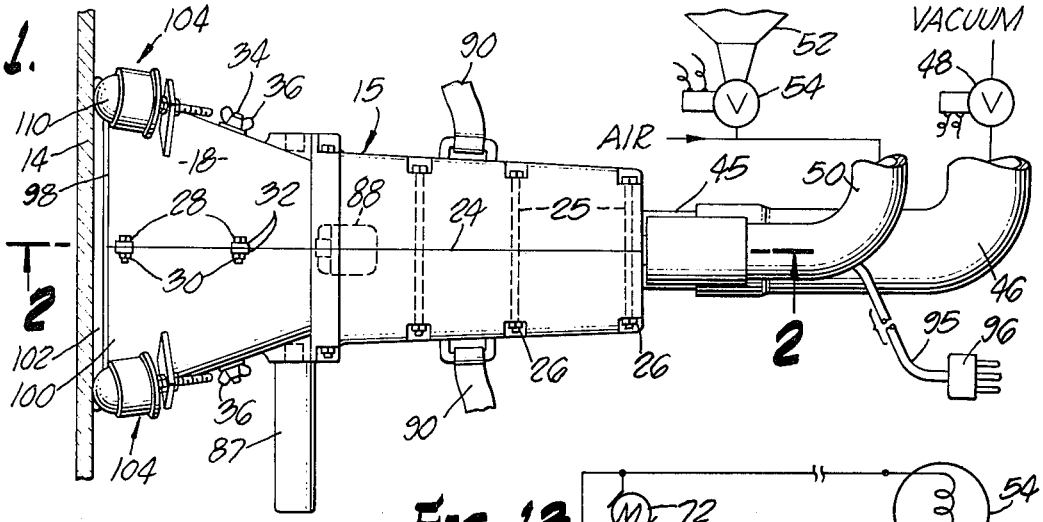
FIG. 13.
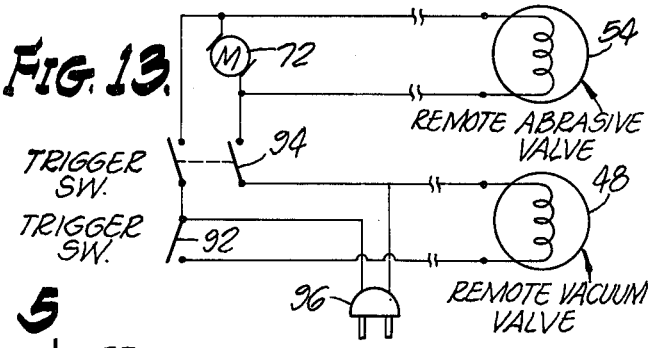
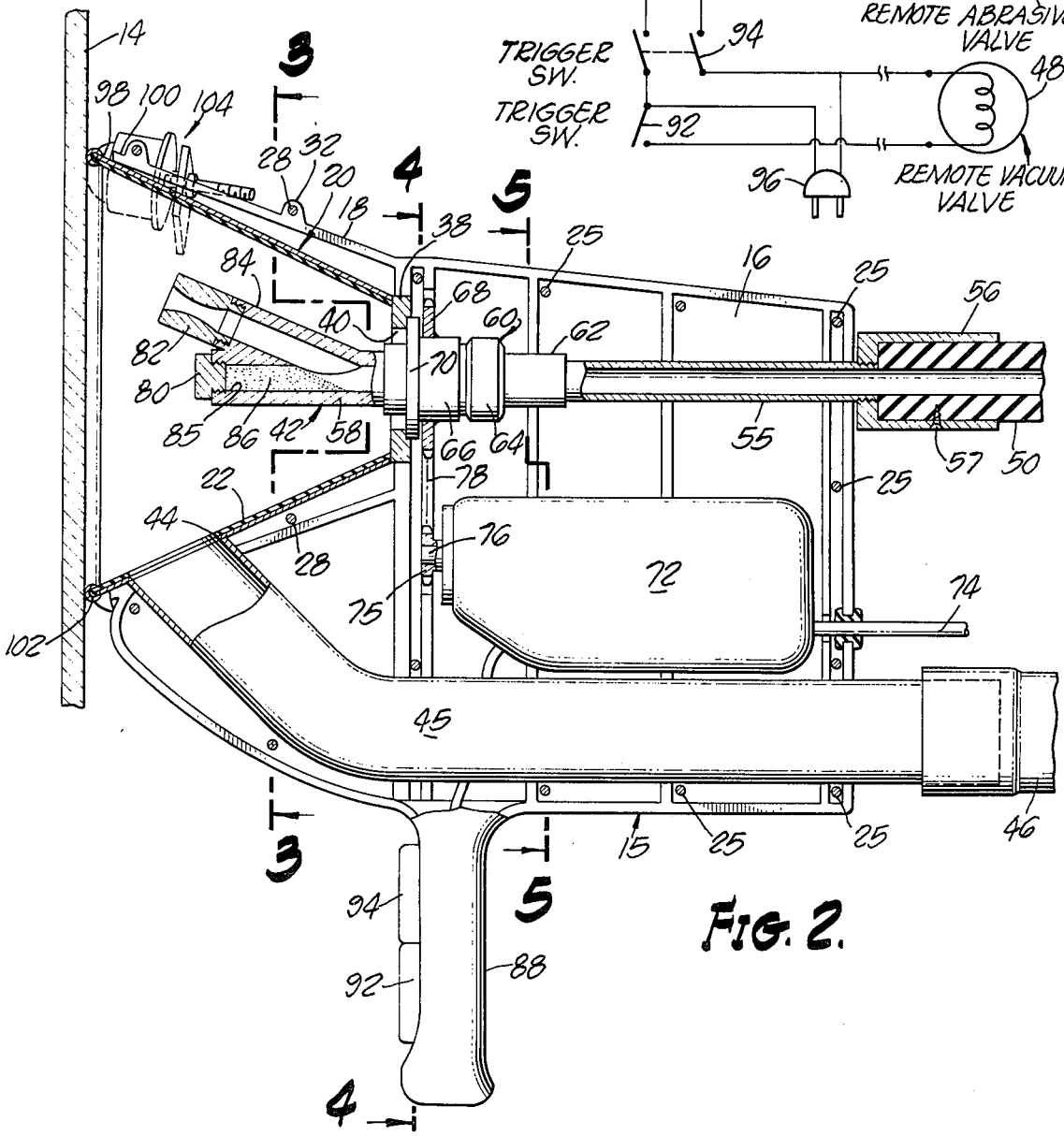
FIG. 2.

PORTABLE SANDBLASTER

BACKGROUND OF THE INVENTION

The present invention relates generally to sandblasting apparatus, and more particularly to hand-portable sandblasting apparatus for treating surfaces of various configurations including concave, convex, and angular surfaces.

Hand-portable sandblasting devices for this purpose have been known generally, for example, from the Mead et al. U.S. Pat. No. 2,494,773 and the Bishop et al. U.S. Pat. No. 2,483,176.

In both of these above mentioned patents, the interior of the portable casing is a relatively large sandblasting chamber with a forward opening through which a nozzle discharges grit particles against a worksurface that is to be processed. The means to contact the worksurface comprises a circular brush means surrounding the opening of the casing to space the rim of the casing from the worksurface. A suction pump connected to the casing maintains a sufficient vacuum therein to withdraw the spent grit particles from the casing and causes sufficient inflow of air through the surrounding brush means to keep the grit particles from escaping into the atmosphere. The suction pump must operate at exceedingly high capacity in order for the device to function properly, and the required excessive volume of air inflow through the surrounding brush results in the placing of an unduly heavy load on the suction pump.

SUMMARY OF THE INVENTION

The present invention has a number of certain interrelated objects which include the following:

- To provide the sandblasting chamber with a rotary nozzle which extends at an acute angle to its axis of rotation;
- To solve the problem of mounting and actuating such a nozzle;
- To utilize the suction air stream with maximum efficiency;
- To make possible a sandblasting structure of relatively light weight;
- To reduce the volume of atmospheric air leaking into the sandblasting chamber;
- To increase the velocity of the reduced air inflow for positive prevention of escape of the spent grit into the atmosphere; and
- To maintain the required high vacuum in the sandblasting chamber adjacent the worksurface without the high vacuum forcing the sandblasting apparatus against the workpiece so violently as to immobilize the sandblaster.

A number of features of the invention cooperate to fulfill the above noted objects.

One of the features is the concept of providing a relatively small, sealed sandblasting chamber in the form of a conical hood inside the casing with the hood isolated not only from the atmosphere, but also from the remainder of the interior of the casing. The suction pump easily maintains a high vacuum in the relatively small hood because it does not have the burden of maintaining a vacuum in the larger volume of the interior of the casing. With the interior of the casing free from sandblasting grit, the interior of the casing is available for moving parts to rotate the rotary nozzle and the interior of the casing is also available for a motor to actuate the nozzle.

Another of the interrelated features of the invention is the concept of providing the rim of the processing hood with a resilient seal of a suitable impervious material, such as a plastic or elastomer, that is continuous and conforms closely to the configuration of the worksurface. The seal makes intimate contact with the worksurface to reduce the inflow of atmospheric air into the hood and at the same time to increase the velocity of the reduced air inflow for positive prevention of escape of grit particles into the atmosphere.

Maintaining such a high vacuum in the hood creates a problem because it results in high magnitude thrust of the hood in a direction towards the workpiece. If unopposed, this thrust would severely compress the resilient seal to cause the seal to function as a brake to make it impossible for the operator to shift the apparatus over the worksurface. This problem is met by diverting a large portion of this force to thrust members that surround the operating hood and make rolling contact with the worksurface. In the preferred practice of the invention adjustable thrust members are employed that utilize captive balls in rolling contact with the worksurface.

Another object of the invention is to provide a single sandblasting apparatus that is readily adaptable to worksurfaces of various configurations. For this purpose the invention provides interchangeable processing hoods which are respectively designed to cooperate with worksurfaces of planar, concave, convex and angular cross-sectional configurations.

A still further object of the invention is to provide a mode of operating control that is not only highly convenient for the operator but also promotes the rate of production by the operator. Communication between the suction pump and the sandblasting hood is controlled by a first valve. Compressed air is supplied continuously to the rotating nozzle in the hood, but grit particles are added to the air stream only when a second valve is opened. The two valves are operated by remote control and in the preferred practice of the invention a handle on the casing that facilitates maneuvering of the sandblasting device has two finger-operated triggers for controlling the two valves respectively. When the sandblasting device is initially applied to a worksurface, the vacuum valve is opened by remote control to establish a vacuum in the operating hood and then the grit valve is operated by remote control to initiate the sandblasting operation. To terminate a sandblasting operation, first the grit valve is closed and subsequently the vacuum valve is closed.

The features and advantages of the invention may be understood from the following detailed description and the accompanying drawings.

BRIEF DESCRIPTION OF THE DRAWINGS

In the drawings, which are to be regarded as merely illustrative:

FIG. 1 is a side elevation of the presently preferred embodiment of the invention with the apparatus applied to a vertical planar worksurface;

FIG. 2 is an enlarged fragmentary section taken along the line 2—2 of FIG. 1;

FIG. 13 is a wiring diagram of the control system of the sandblaster.

DESCRIPTION OF THE PREFERRED EMBODIMENTS OF THE INVENTION

Figure 3:
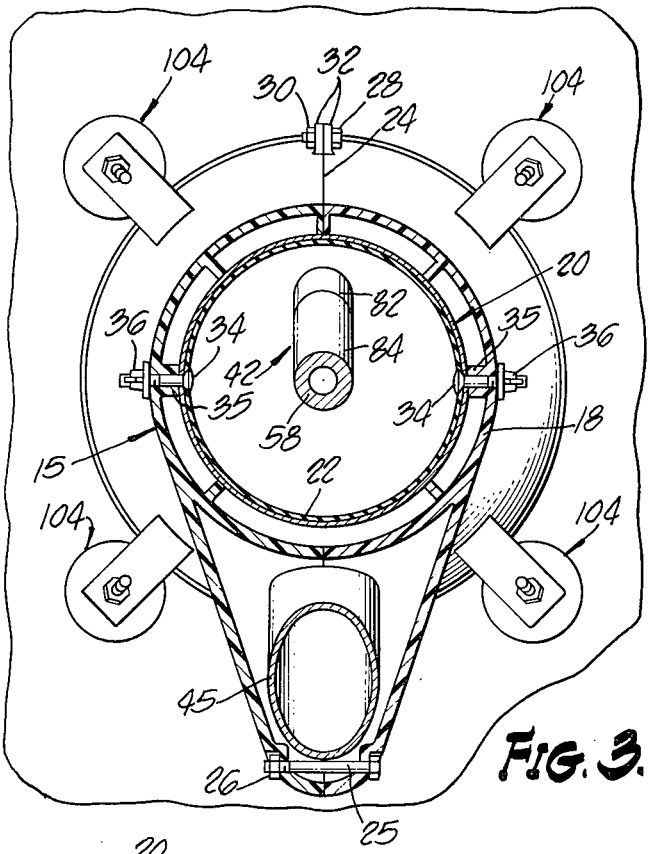
FIG. 3 is a transverse section taken along the line 3—3 of FIG. 2.
Figure 4:
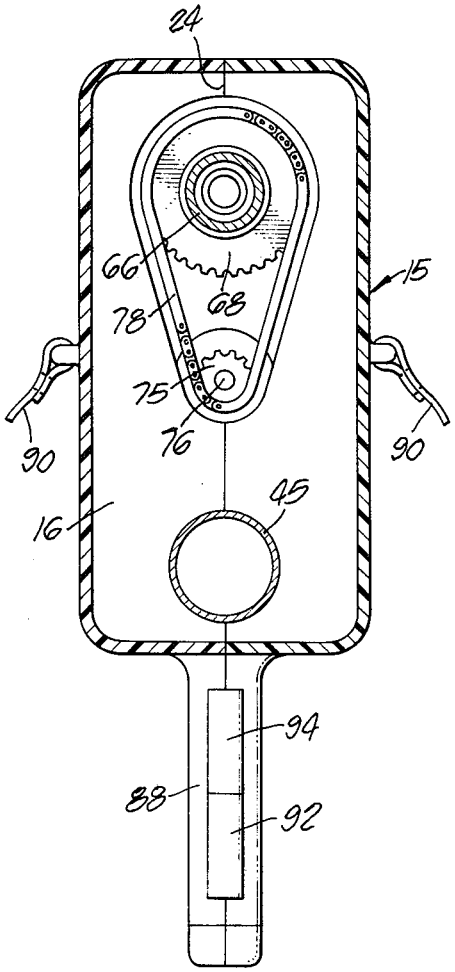
FIG. 4 is a transverse section taken along the line 4—4 of FIG. 2.

Referring to the first embodiment of the invention shown in FIGS. 1-7, which is employed to process a vertical flat worksurface 14, the structure of the sandblasting apparatus includes a lightweight plastic casing, generally designated 15, having an inward portion forming a compartment 16 of rectangular cross section and having an outward portion in the form of a conical skirt 18 that is open towards the workpiece 14. Surrounded by the conical skirt 18 is a sandblasting chamber in the form of a conical hood 20, the outer open end of which registers with the open end of the conical skirt and is reinforced by the conical skirt. In a well known manner, the conical hood 20 is provided with a liner 22 of rubber-like material that resists the abrasive affect of high velocity grit particles.

The casing 15 is divided longitudinally into two sections which mate along parting lines 24 that are shown in FIGS. 1, 3, 4 and 5. In the region of the rectangular compartment 16, the two sections of the casing are releasably interconnected by relatively long bolts 25 equipped with nuts 26 and in the region of the conical skirt 18 the two casing sections are interconnected by short bolts 28 and nuts 30, the short bolts extending through apertured ears 32 of the casing.

Figure 6:
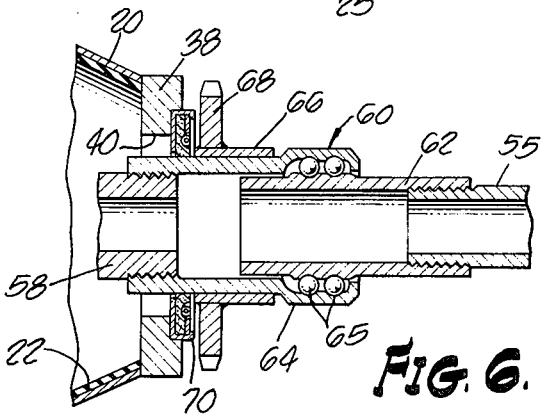
FIG. 6 is a fragmentary longitudinal sectional view showing the construction of the rotary joint for the rotary nozzle.
Figure 5:
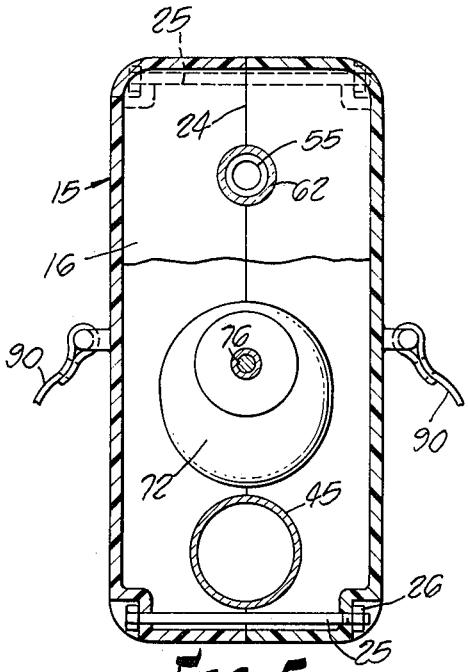
FIG. 5 is a transverse section taken along the line 5—5 of FIG. 2.

As shown in FIG. 3, the conical sandblasting hood 20 is anchored to the surrounding conical skirt 18 of the casing 15 by suitable bolts 34 that extend through internal radial bosses 35 of the conical skirt 18 and are provided with external wing nuts 36. As shown in FIGS. 2 and 6, the sandblasting hood 20 has an inner end wall 38 that is formed with a relatively large axial opening 40 to clear a nozzle assembly that is generally designated by numeral 42. The sandblasting hood 20 also has a circular side opening 44 that registers with the inlet end of a curved suction tube 45 inside the casing 15.

A conduit in the form of a hose 46 from a remote suction pump (not shown) is connected to the curved suction tube 45 and, as indicated diagrammatically in FIG. 1, is provided with a remote solenoid valve 48. A supply conduit in the form of a hose 50 connects the nozzle assembly 42 to a remote compressor (not shown) and a grit tank 52 to which the grit is returned for recycling. Grit is released from the tank 52 into the stream of compressed air whenever a remote solenoid valve 54 is opened.

A suitable system that includes a remote suction pump and a remote air compressor for operating the sandblaster may be of the general character that is shown diagrammatically in a copending Rose et al. application Ser. No. 518,579, filed Oct. 29, 1974, now U.S. Pat. No. 3,916,568. A similar system is disclosed in the previously mentioned Bishop et al. U.S. Pat. No. 2,483,176, which patent is hereby incorporated into the present disclosure by reference.

As indicated in FIG. 2, the compressed air hose 50 is connected to a pipe 55 inside the casing 15, the connecting structure including a cup-shaped member 56 that is screw threadedly attached to the pipe 55 and embraces the end of the hose 50. The cup-shaped member 56 is provided with at least one radial screw 57 to engage the enclosed end of the hose 50.

The rotary nozzle assembly 42 has a tubular stem 58 connected to the pipe 55 by a rotary joint 60 (FIG. 2) which rotary joint may be of the construction shown in FIG. 6 wherein an inner sleeve 62 is screwed onto the pipe 55 and an outer sleeve 64 is fixedly connected to the tubular stem 58. The two sleeves 62 and 64 overlap to form races for two sets of balls 65 that permit the nozzle assembly to rotate in a substantially frictionless manner. It is to be noted that the grit-laden air streaming through the rotary joint at high velocity creates a venturi effect that causes atmospheric air to be sucked inwardly past the balls 65 at relatively high velocity to keep the grit from reaching and abrading the balls.

Fixedly embracing the rotatable outer sleeve 64 is a collar 66 that fixedly carries a sprocket 68 for actuating the rotary nozzle assembly 42. A suitable ring-shaped seal 70 is interposed between the collar 66 and the inner end wall 38 of the sandblasting hood 20 to prevent grit from escaping from the interior of the hood through the axial opening 40 into the compartment 16 of the casing 15. With the compartment 16 free from grit it is a suitable environment for a motor 72 that is energized by an electric cable 74. A sprocket 75 on the shaft 76 of the motor 72 is operatively connected to the previously mentioned sprocket 68 of the rotary joint by a sprocket chain 78 to rotate the nozzle assembly 42 at a desired rate.

The outer end of the stem 58 of the nozzle assembly 42 is closed by a screw threaded plug 80 and a nozzle member 82 of the nozzle assembly is on the end of a tube 84 that branches from the stem 58 at an acute angle. An important advantage of this arrangement is that the stem 58 provides a pocket 85 beyond the branch tube 84 which fills automatically with a body of grit 86. It is apparent that the body of grit 86 serves as means to deflect the grit-laden air stream into the branch tube 84 and such a deflector is self-renewing to solve the problem of deflecting the grit-laden air stream without the deflector being abraded by the grit.

The casing 15 may be provided with any suitable handle means to facilitate handling and maneuvering the sandblaster. In this particular embodiment of the invention the casing 15 has two radial handles 87 and 88 in 90° angular relation and, in addition, the casing 15 is provided with a suitable shoulder strap 90 to ease the burden on the operator.

The handle 88 is provided with a first switch in the form of a trigger switch 92 to control the remote vacuum valve 48, and is also provided with a second switch in the form of a trigger switch 94 to control both the motor 72 and the remote abrasive valve 54. Referring to the wiring diagram in FIG. 13, the trigger switch 92 is a toggle switch and the trigger switch 94 is a double pole switch. As illustrated in FIG. 1 and shown diagrammatically in FIG. 13, the control circuit is energized by an electric cable 95 equipped with a suitable plug 96.

Figure 7:
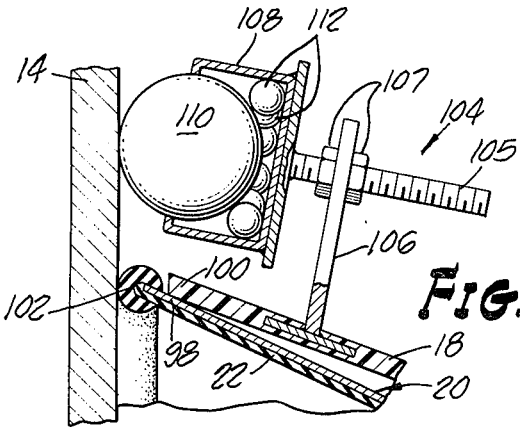
FIG. 7 is a greatly enlarged fragmentary section showing one of the thrust members that diverts force away from the rim seal of the processing hood.

As shown in FIGS. 2 and 7, the rim 98 of the sandblasting hood 20 extends beyond the rim 100 of the conical skirt 18 of the casing 15 and the hood rim 98 is straddled by a continuous resilient sealing strip 102 of an impervious plastic, elastomer, or other suitable material, which cooperates with the worksurface 14 to minimize the leakage of atmospheric air into the interior of the sandblasting hood. With the seal 102 in intimate contact with the worksurface 14 a relatively high vacuum is created in the sandblasting hood so that any inward leakage flow of atmospheric air under the sealing strip is exceedingly restricted and, accordingly, is of exceedingly high velocity to preclude the escape of any grit particles from the hood to the atmosphere.

The high vacuum in the sandblasting hood creates a pressure differential across the hood to result in a force of high magnitude that presses the hood against the worksurface 14 with resultant compression of the sealing strip 102. In effect, the compressed sealing strip 102 acts as a brake shoe that resists relative movement of the sandblasting hood along the worksurface 14. Unless some provision is made for reduction of this brake pressure, the manual strength required to shift the apparatus along the worksurface would exceed the strength of even the strongest operator or at best would require such effort as to quickly tire the operator.

To reduce this braking force, a plurality of thrust members 104 are provided to divert an adjustable portion of the force directly to the worksurface 14 to bypass the sealing strip 102. There must be at least three of the thrust members 104 and in this instance, as shown in FIG. 3, there are four of the thrust members.

As shown in FIG. 7, each thrust member 104 has a screw-threaded shank 105 that extends through a smooth aperture in a radial ear 106 of the skirt 18 of the casing 15, the threaded shank being provided with two nuts 107 to abut opposite faces of the ear. It is apparent that the two nuts 107 may be loosened to permit the shank 105 to be adjusted longitudinally towards or away from the worksurface 14.

The leading end of the shank 105 carries a cylindrical cage 108 that rotatably captivates a smooth hard metal ball 110, the metal ball backing against a plurality of smaller metal balls 112 to minimize frictional resistance to rotation of the larger ball. It is a simple matter to adjust the thrust members 104 towards the worksurface 14 to divert sufficient pressure away from the sealing strip 102 to make it relatively easy for the operator to shift the apparatus along the worksurface.

The manner in which the described embodiment of the invention functions for its purpose may be readily understood from the following description. The remote compressor is continuously energized through the time period in which the sandblaster is employed to process a worksurface 14. With the rotary nozzle idle and with compressed air free of grit discharged from the nozzle, the apparatus is applied to the worksurface 14 to place the sealing strip 102 in intimate contact with the surface. Trigger switch 92 is then actuated to energize the remote vacuum valve 48 to create suction in the suction tube 45 to result in a desirably high vacuum inside the sandblasting hood 20. If necessary, the four thrust members 104 are then adjusted to adjust the pressure on the sealing strip 102 to minimize the volume of inflowing atmospheric air and yet to permit the operator to shift the apparatus freely along the worksurface.

The amount of pressure that urges the apparatus against the worksurface 14 varies, of course, with the leakage under the continuous seal 102 and this leakage varies with the roughness of the worksurface. In practice, it is a simple matter to adjust the thrust members 104 for the desired freedom of movement of the apparatus along any particular worksurface.

With the sandblasting hood 20 against the worksurface 14 and with the desired relatively high vacuum created inside the sandblasting hood, the operator actuates the second trigger switch 94 for energization of the motor 72 and simultaneous energization of the remote abrasive valve 54. The motor initiates rotation of the nozzle assembly 42 and the opening of the remote abrasive valve 54 introduces grit into the stream of compressed air that is delivered to the nozzle assembly.

The operator moves the apparatus freely over the worksurface until a desired area of the worksurface is processed and then cuts off the sandblasting operation to begin again at a new area of a worksurface. To interrupt the sandblasting operation, the operator actuates the trigger switch 94 to deenergize the motor 72 and close the remote abrasive valve 54. After a short pause, the operator actuates the trigger switch 92 to cut off suction flow through the suction tube 45 and thereby terminate the vacuum inside the sandblasting hood 20.

Figure 8:
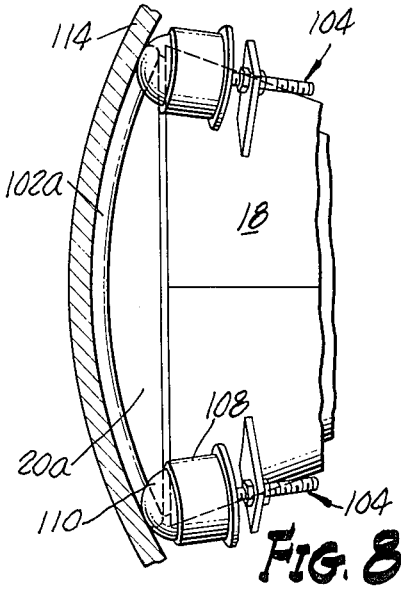
FIG. 8 is a fragmentary view partly in section showing how thrust members cooperate with a concave worksurface.

FIG. 8 shows how a sandblasting hood 20*a* may be substituted for the previously described sanblasting hood 20 to adapt the apparatus for processing a concave worksurface 114 which worksurface may be the interior of a cylindrical tank. A sandblasting hood may be released from the casing 15 by simply removing the bolts 34 shown in FIG. 3. Since the axial opening 40 (FIG. 2) in the inner end wall 38 of the hood is not large enough to clear the nozzle assembly 42, the nozzle assembly must be disengaged from the rotary joint 60 before the hood is removed.

The rim of the hood 20*a* is provided in the usual manner with a continuous sealing strip 102*a* and the rim of the sandblasting hood is so shaped that the continuous sealing strip 102*a* conforms to the concave curvature of the worksurface 114. The four thrust members 104 are adjusted as shown in FIG. 8 to contact the concave worksurface 114 for diverting to the worksurface a desired portion of the vacuum-created thrust of the sandblasting hood against the worksurface.

Figure 9:
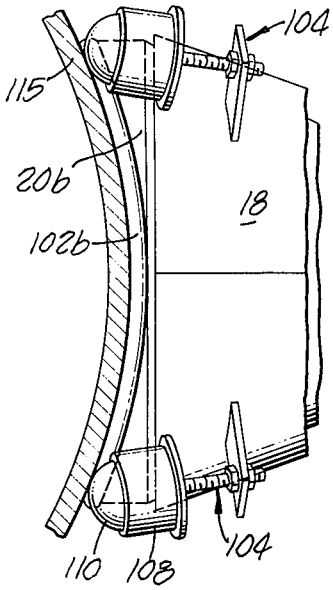
FIG. 9 is a similar view showing how the thrust members cooperate with a convex worksurface.

FIG. 9 shows how a sandblasting hood 20*b* may be substituted for the sandblasting hood 20 to enable the apparatus to sandblast a convex worksurface 115. The rim of the sandblasting hood 20*b* and the continuous sealing strip 102*b* thereon conform to the curvature of the convex worksurface 115, which worksurface may be the exterior of a cylindrical tank. The thrust members 104 in FIG. 9 are more advanced than the thrust members in FIG. 8 to make contact with the worksurface for relieving the pressure on the continuous seal 102*b*.

Figure 10:
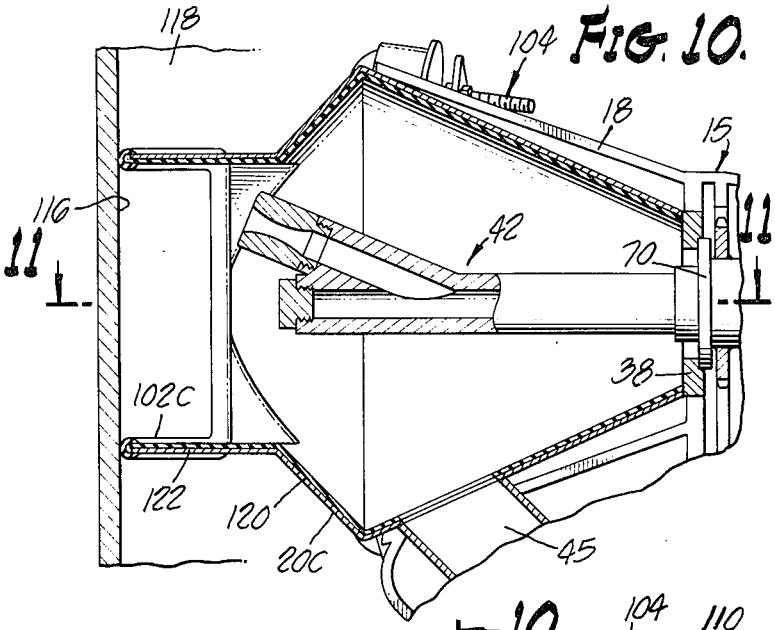
FIG. 10 is a fragmentary longitudinal section taken along the line 10—10 of FIG. 12 showing a processing hood that is shaped to cooperate with an angular worksurface.
Figure 12:
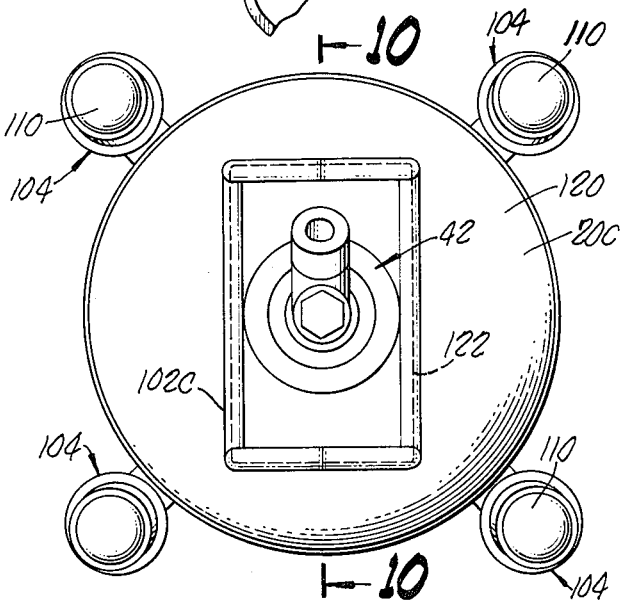
FIG. 12 is a front elevation of the structure shown in FIGS. 10 and 11.
Figure 11:
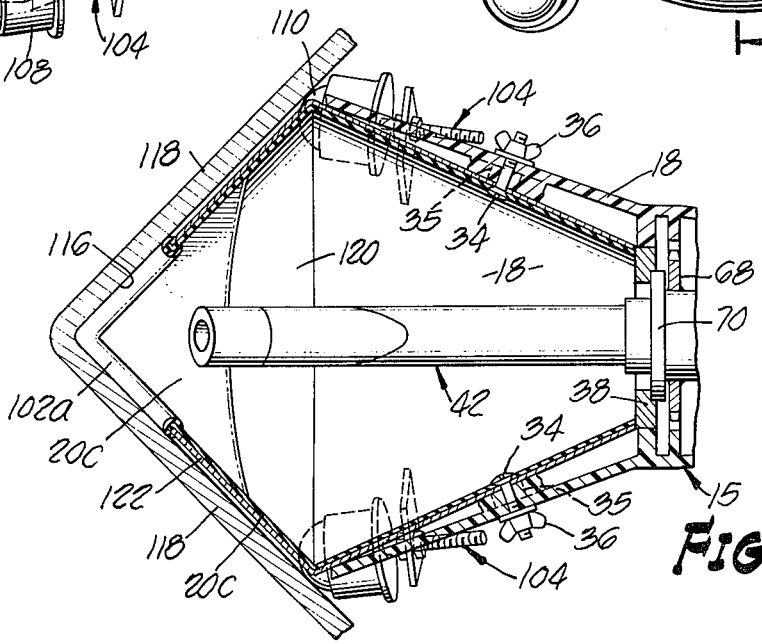
FIG. 11 is a fragmentary longitudinal section along the line 11—11 of FIG. 10.

FIGS. 10–12 show the sandblasting apparatus equipped with a removable sandblasting hood 20*c* to make it possible for the apparatus to sandblast an angular worksurface 116 which is formed by two walls 118 in 90° angular relation. The sandblasting hood 20*c* has a dished outer end wall 120 which serves as a transition to an extension 122 of the hood that is rectangular in cross section and the leading end of which is angular to confrom to the configuration of the angular worksurface 116. The angular rim of the hood 20*c* conforms to the configuration of the angular worksurface 116 and is provided with the usual continuous seal 102*c* for intimate contact with the worksurface. Referring to FIG. 11, two of the four thrust members 104 are adjusted for pressure contact against one of the walls 118 and the other two thrust members are adjusted for rolling contact against the other wall 118.

The description in specific detail of the presently preferred practice of the invention will suggest various changes, substitutions and other departures from the disclosure within the spirit and scope of the appended claims.

What is claimed is:

1. In portable apparatus to sandblast a worksurface of a particular configuration, the combination of:

a structure comprising an outer casing from which a sandblasting hood is rigidly supported inside the casing, the casing having an outer end opening and the sandblasting hood having an outer end extending through the outer end opening of the casing to provide a projecting open end for application to the worksurface;

a rotatable sandblasting nozzle in the hood directed towards the end opening thereof;

means to deliver to the nozzle a stream of grit-laden compressed air;

a seal carried by the projecting open end of the sandblasting hood, said seal extending beyond said projecting open end and being adapted to make intimate contact with said worksurface and cooperate therewith to isolate the interior of the sandblasting hood chamber from the atmosphere and from the interior of the casing;

means to withdraw an air stream from the sandblasting hood to entrain particles resulting from the sandblasting operation and to continuously draw atmospheric air into the hood past the seal at high velocity to prevent escape of the grit particles past the seal;

said withdrawing means operating at a rate to maintain a relatively high vacuum in the sandblasting hood and thus compress said seal against the worksurface with a fluid pressure differential force which, if unopposed, would tend to immobilize the structure relative to the worksurface; and thrust means carried by said outer casing and extending therefrom for moving contact with the worksurface to divert a sufficient portion of said force from the seal to make the structure readily manually movable along the worksurface.

2. A combination as set forth in claim 1 in which said thrust means comprises a plurality of thrust members carrying worksurface engageable rotatable balls, each of said thrust members being screw threadedly adjustable on said outer casing towards and away from the worksurface.

3. A combination as set forth in claim 1 in which the means to deliver the grit-laden stream of compressed air to the nozzle includes: a hopper for grit particles; an air line; and a grit valve to release grit from the hopper into the air line;

and which includes means on said structure for remote control of the grit valve.

4. A combination as set forth in claim 3 which includes a remote valve to control air flow through said withdrawing means;

and which includes means on the casing to control said valve.

5. A combination as set forth in claim 4 which includes a motor inside the casing to rotate said nozzle;

and which includes means on the casing for simultaneous control of the motor and the grit valve.

6. A combination as set forth in claim 1 in which said withdrawing means comprises a remote suction pump and a conduit from the suction pump to the sandblasting hood;

which includes remote means to control air flow through the conduit;

and which includes means on the casing for remote control of said flow control means.

7. A combination as set forth in claim 6 in which the means to deliver the grit-laden stream of compressed air to the nozzle includes: a hopper for grit particles; an air line; and a grit valve to release grit from the hopper into the air line;

and which includes means on said structure for remote control of the grit valve.

8. A combination as set forth in claim 1 which includes control means on the structure to control the remote introduction of grit into the compressed air stream.

9. A combination as set forth in claim 8 which includes a motor to rotate said nozzle and which includes means on the structure for simultaneous control of the motor and the introduction of grit into the compressed air stream.

10. A combination as set forth in claim 8 which further includes means on the structure to control at a remote point said means for withdrawing an air stream from the sandblasting hood.

11. A combination as set forth in claim 1 in which said nozzle is supported on and extends at a fixed acute angle from a rotatably supported tubular member for conducting grit-laden compressed air to the nozzle;

and which includes a motor carried by said structure to rotate said tubular member and the nozzle as a unit.

12. A combination as set forth in claim 11 in which the means to deliver grit-laden compressed air to the nozzle includes a remote compressor and a fixed conduit leading to said structure;

and in which the tubular member and said conduit are coaxially interconnected by a rotary joint.

13. A combination as set forth in claim 12 in which said rotary joint comprises:

a rigid end portion of said conduit;

a sleeve connected to said tubular member and rotatably surrounding said end portion;

and anti-friction bearing means interposed between the end portion and the surrounding sleeve, whereby air from the atmosphere is drawn through the anti-friction means by venturi action to keep grit out of the anti-friction means.

14. A combination as set forth in claim 11;

in which said nozzle is supported from said tubular member by a branch connection extending at an acute angle relative to the axis of rotation of the nozzle;

and in which the outer end of said tubular member is closed beyond said branch connection to permit grit particles to accumulate in the tubular member up to the region where the nozzle branches from the tubular member, whereby the accumulated grit particles serve as a continually renewed means to deflect the grit-laden air stream into said branch connection and the nozzle.

15. A combination as set forth in claim 1 in which the hood is releasably attached to the casing to permit replacement of the hood by another hood having its open end shaped to conform to a worksurface of a different configuration.

16. In an apparatus for sandblasting worksurfaces of different configurations, the combination of:

a casing having an outer end opening;

a set of sandblasting hoods with open ends for use interchangeably in the casing, each hood being releasably attachable to the casing inside the casing with the open end of the hood conforming to the outer end opening of the casing, each of said hoods having a continuous seal around the rim of its open end with the seal extending beyond the end opening of the casing and being adapted to contact the worksurface and cooperate therewith to confine in the hood particles resulting from the sandblasting operation, the sandblasting hoods of said set having their open ends and seals shaped to conform to different configurations of worksurfaces;

blasting nozzle means for employment in each of the processing chambers;

a supply conduit to deliver to the nozzle means a stream of grit-laden compressed air;

means to cooperate with each of the interchangeable hoods to withdraw therefrom an airstream entraining the particles resulting from the sandblast operation, said withdrawing means operating at a rate to maintain a vacuum in the sandblasting hood and thus compress said seal against the worksurface with a force which, if unopposed, would tend to immobilize the seal relative to the worksurface; and thrust means mounted on and extending from said casing and equipped with means for moving contact with a worksurface to divert a sufficient portion of said force from the seal to the worksurface to make the structure readily manually movable along the worksurface.

* * * * *